US007015785B2

(12) United States Patent
Wu et al.

(10) Patent No.: US 7,015,785 B2
(45) Date of Patent: Mar. 21, 2006

(54) INVERTER TRANSFORMER AND CORE STRUCTURE THEREOF

(75) Inventors: Chen-Feng Wu, Pa Te (TW); Ming Yeh, Pan Chiao (TW)

(73) Assignee: Delta Electronics, Inc., (TW)

( * ) Notice: Subject to any disclaimer, the term of this patent is extended or adjusted under 35 U.S.C. 154(b) by 136 days.

(21) Appl. No.: 10/735,219

(22) Filed: Dec. 12, 2003

(65) Prior Publication Data

US 2004/0196131 A1 Oct. 7, 2004

(30) Foreign Application Priority Data

Apr. 1, 2003 (TW) ..... 92107437 A

(51) Int. Cl.
*H01F 27/24* (2006.01)

(52) U.S. Cl. ..... 336/212

(58) Field of Classification Search ..... 336/83, 336/170, 200, 212, 220–223, 232

See application file for complete search history.

(56) References Cited

U.S. PATENT DOCUMENTS

| | | | | |
|---|---|---|---|---|
| 1,826,890 | A * | 10/1931 | Kouyoumjian | 323/310 |
| 1,893,251 | A * | 1/1933 | Sola | 336/155 |
| 5,760,670 | A * | 6/1998 | Yeh et al. | 336/134 |
| 6,714,111 | B1 * | 3/2004 | Suzuki | 336/110 |
| 6,876,161 | B1 * | 4/2005 | Chung | 315/368.28 |
| 6,894,596 | B1 * | 5/2005 | Suzuki | 336/83 |

* cited by examiner

*Primary Examiner*—Tuyen T Nguyen
(74) *Attorney, Agent, or Firm*—The Webb Law Firm

(57) ABSTRACT

An inverter transformer and a core structure thereof are described. The core structure of the inverter transformer has a first core and a second core. The first core has a plurality of fork elements, a connection element, and a bottom element. The fork elements are parallel with each other and connect with the connection element. The connection element further connects with the bottom element, and therefore the bottom element and the fork elements are configured at respective sides of the connection element. The second core has a plurality of fork position openings and a bottom opening. The fork position openings correspond one-to-one with the fork elements and the bottom opening corresponds to the bottom element. The second core further includes a bottom indentation and a plurality of fork position indentations to form gaps and lock a primary coil module and secondary coil modules.

14 Claims, 3 Drawing Sheets

INVERTER TRANSFORMER AND CORE STRUCTURE THEREOF

FIELD OF THE INVENTION

The present invention relates to a core structure, and especially, to a core structure of an inverter transformer.

BACKGROUND OF THE INVENTION

Due to the rapid progress of the electrical and semiconductor technology, liquid crystal display (LCD) is widely utilized in electrical appliance displays. The LCD has many advantages over other conventional types of displays including high display quality, small volume occupation, a light weight, a low driving voltage and a low power consumption. Hence, LCDs are widely used in small portable televisions, mobile telephones, video recording units, notebook computers, desktop monitors, projector televisions and so on. Therefore, the LCD has gradually replaced the conventional cathode ray tube (CRT) as a mainstream display unit.

Backlights of LCD displays of notebook computers or portable electrical products normally are a cold cathode fluorescent lamp because the cold cathode fluorescent lamp possess higher backlight luminous efficacy. However, the cold cathode fluorescent lamp is triggered by alternating current signals, and therefore needs an inverter transformer for power.

Conventionally, each cold cathode fluorescent lamp uses an inverter transformer for a power supply. Due to the increased size of LCD panels, the backlight needs to provide more brightness to light up the LCD. Therefore, the backlight has to increase the quantity of the cold cathode fluorescent lamps to provide greater illumination for an LCD, and more inverter transformers are necessary to supply enough power to the cold cathode fluorescent lamps. Hence, the LCD volume is increased and the manufacturing cost is also increased due to the increase in number of components.

SUMMARY OF THE INVENTION

One object of the present invention is to provide a core structure of an inverter transformer having a plural output.

Another object of the present invention is to provide a core structure of an inverter transformer whose winding direction is parallel to an assembly direction of the inverter transformer fixed on a print circuit board so as to always maintain an inverter transformer with a lower profile.

Yet another object of the present invention is to provide an inverter transformer having partition troughs to divide the voltage of the inverter transformer so as to enhance the insulation effect of the inverter transformer.

To achieve these and other advantages and in accordance with the object of the invention, the present invention provides a transformer core structure utilized in an inverter transformer. The transformer core structure has a first core and a second core. The first core has a plurality of fork elements, a connection element, and a bottom element. The fork elements are parallel to each other and couple to one side of the connection element. The bottom element couples to another side of the connection element. Therefore, the fork elements and the bottom element are disposed on two respective sides of the connection element.

The second core has a bottom opening and a plurality of fork position openings equal to the quantity of the fork elements. When the first core is coupled to the second core, each of the fork position openings corresponds to one of the fork elements and the bottom opening corresponds to the bottom element.

In additional, the second core further has a bottom indentation and a plurality of fork position indentations to form a bottom gap and a plurality of fork position gaps between the first core and the second core when the first core is coupled to the second core. The bottom indentation and the fork position indentations further lock the primary coil module and the secondary coil modules so as to be fixed on the first core when the second core is coupled to the first core. Furthermore, the transformer core structure can be achieved by a Y core with two fork elements and a corresponding U core.

Another aspect of the present invention provides an inverter transformer. The inverter transformer has a first core, a second core, a primary coil module, and a plurality of secondary coil modules. The primary coil module is coupled to the bottom element of the first core and the secondary coil modules are coupled to the fork elements, one-to-one. Therefore, the primary coil module and the secondary coil modules are disposed on two respective sides of the connection element. Each of the secondary coil modules is parallel to each other.

The secondary coil module of the inverter converter further comprises a plurality of partition troughs which are parallel to a assembly direction of the inverter transformer fixed on a print circuit board so that magnetic circuits formed by the secondary coil module are parallel to the assembly direction of the inverter transformer fixed on the print circuit board. Hence, the thickness of the inverter converter according to the present invention can be efficiently controlled.

Therefore, the transformer core structure according to the present invention can provide a plurality of outputs for a single inverter transformer inverter to supply a plurality of cold cathode fluorescent lamps. Accordingly, the quality of the inverter transformer can be efficiently reduced, the manufacturing cost can be reduced, and the insulation capability thereof can be enhanced.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is the best presently contemplated mode of carrying out the present invention. This description is not to be taken in a limiting sense but is made merely for the purpose of describing the general principles of the invention. The scope of the invention should be determined by referencing the appended claims.

Figure 1:
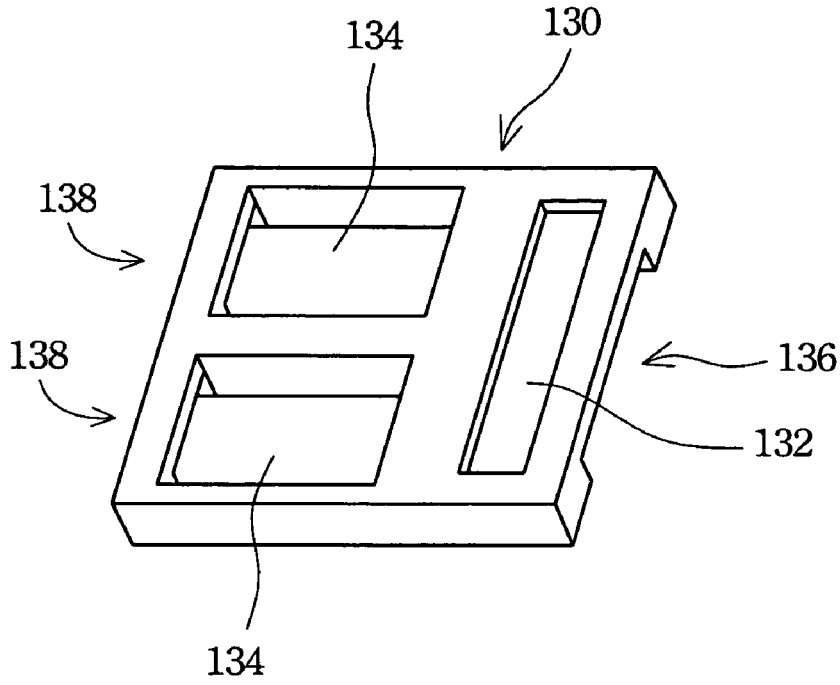
FIG. 1 is a preferred embodiment of a core structure of an inverter transformer according to the present invention.
Figure 1:
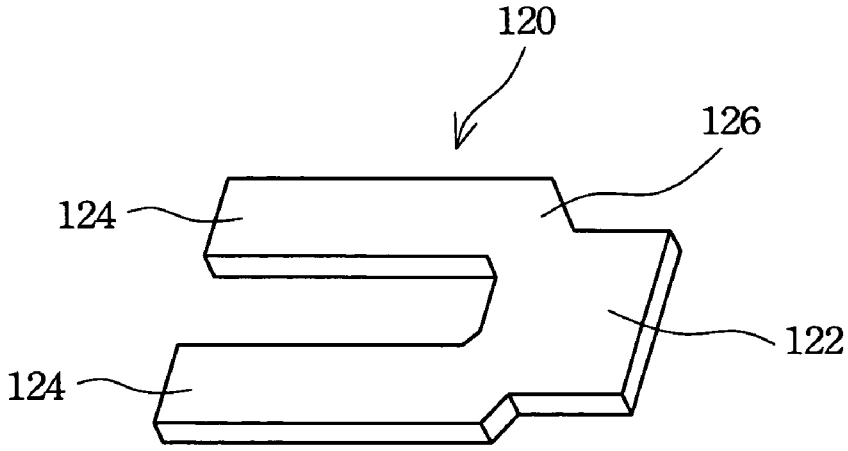
Figure 2A:
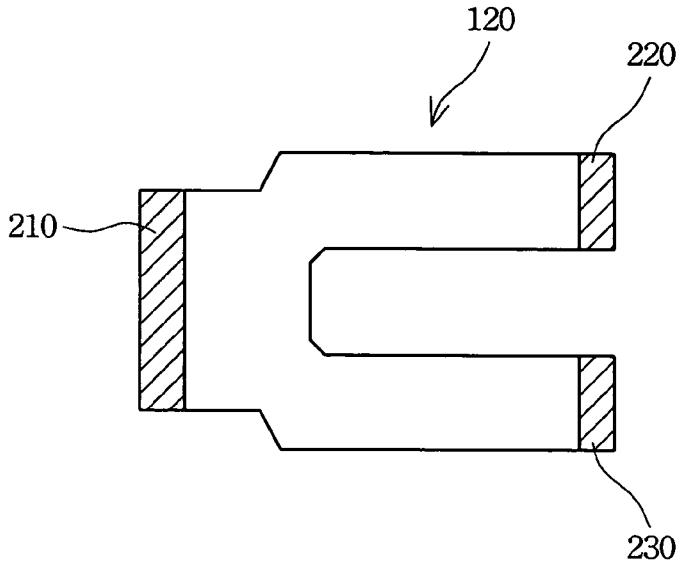
FIG. 2A is a schematic top view of a Y core of the preferred embodiment of FIG. 1.
Figure 2B:
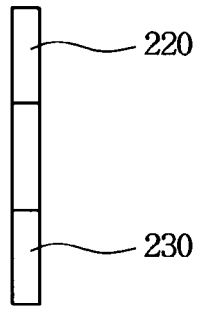
FIG. 2B is a schematic side view of the Y core of FIG. 2A.
Figure 3A:
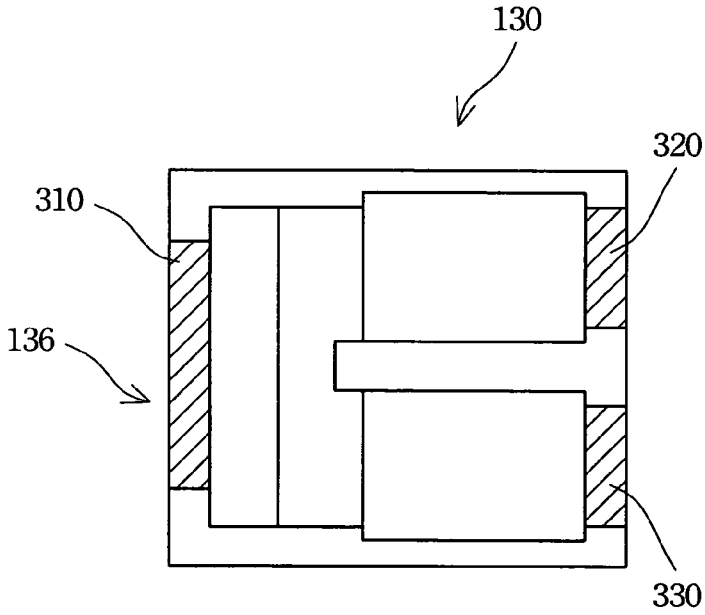
FIG. 3A is a schematic top view of a U core of the preferred embodiment of FIG. 1.
Figure 3B:
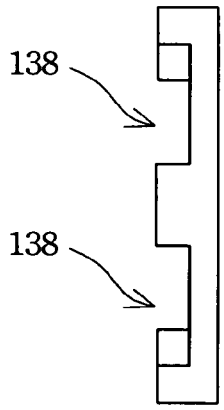
FIG. 3B is a schematic side view of the U core of FIG. 3A.

FIG. 1 is a preferred embodiment of a core structure of an inverter transformer according to the present invention. The preferred embodiment of the core structure of the inverter transformer according to the present invention has a Y core 120 and a U core 130. FIG. 2A is a schematic top view of a Y core of the preferred embodiment of FIG. 1 and FIG. 2B is a schematic side view thereof. FIG. 3A is a schematic top view of a U core of the preferred embodiment of FIG. 1 and FIG. 3B is a schematic side view thereof.

The Y core 120 formed by a flat ferrite core material has a bottom element 122 and at least two fork elements 124 coupling to the bottom element 122 with a connection element 126. The fork elements 124 are disposed parallel to each other. The fork elements 124 and the bottom element 122 are disposed on two respective sides of the connection element 126. Each fork element 124 couples to a secondary coil module and the bottom element 122 couples to a primary coil module.

The U core 130 has a bottom opening 132, at least of two fork position opening 134, a bottom indentation 136 and at least two fork position indentation 138. The bottom opening 132 is coupled to the bottom element 122 of the Y core 120 and the primary coil module is stored therein. The fork position opening 134 is coupled to the fork element 124 of the Y core 120 and the secondary coil module is stored therein. The other portion of the U core 130 provides magnetic circuits for the inverter transformer. The bottom indentation 136 and the fork position indentation 138 are utilized to form gaps between the U core 130 and the Y core 120 and, at the same time, lock the primary coil module and the secondary coil module.

Referring to FIGS. 2A, 2B, 3A, and 3B, when the Y core 120 is coupled to the U core 130, the positions 210, 220, and 230 of the Y core 120 correspond to positions 310, 320, and 330 of the U core 130. Therefore, the bottom indentation 136 and the fork position indentation 138 form gaps with Y core 120 therein. The gaps provide predetermined spaces between the Y core 120 and the U core 130 to provide the inverter transformer according to the present invention with an optimum working condition.

Figure 4:
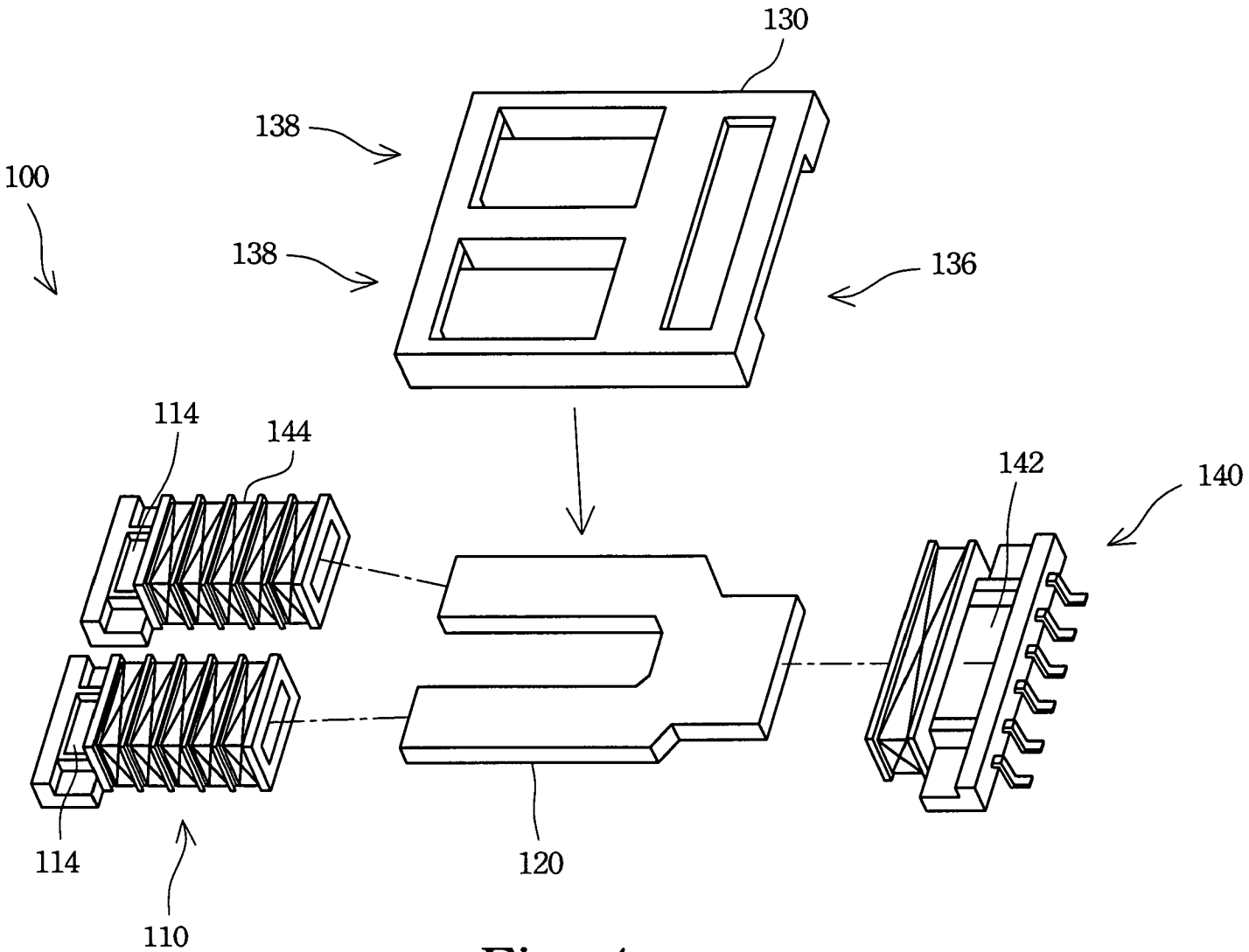
FIG. 4 is an exploded view of an inverter transformer according to the present invention with the preferred embodiment of FIG. 1.

FIG. 4 is an exploded view of an inverter transformer according to the present invention with the preferred embodiment of FIG. 1. The core structure of the inverter transformer according to the present invention couples to a primary coil module 140 and at least two secondary coil module 110. When the inverter transformer 100 is assembled, the positions 220 and 230 of the Y core 120 correspond to trenches 114 of the corresponding secondary coil module 110. The position 210 of the Y core 120 corresponds to trench 142 of the primary coil module 140. Therefore, after the Y core 120 with the primary coil module 140 and the secondary coil module 110 combine with the corresponding bottom indentation 136 and the corresponding fork position indentation 138 of the U core 130, suitable gaps are formed therein. After the primary coil module 140 and the secondary coil module 110 are assembled on the Y core 120, the U core 130 is installed thereon to lock the primary coil module 140 and the secondary coil module 110 by the bottom indentation 136 and the fork position indentation 138. The primary coil module 140 and the secondary coil module 110 can thus be efficiently secured on the Y core 120 and the U core 130.

The secondary coil module 110 further utilizes partition troughs to divide the voltage of the inverter transformer so as to enhance the insulation effect of the inverter transformer. That is to say, the secondary coil 144 is separated into a plurality of partition troughs, and therefore each partition trough has small voltage deviation so as to enhance the insulation effect thereof. In additional, the foregoing partition troughs are parallel to the assembly direction of the inverter transformer 100. The secondary coil 144 is wound into the partition troughs, and therefore the magnetic circuits of the secondary coil 144 are also parallel to the assembly direction of the inverter transformer 100. Hence, when the inverter transformer 100 is installed on a printed circuit board, the thickness of the inverter transformer 100 can be efficiently controlled because the partition troughs and the magnetic circuit are both parallel to the assembly direction of the inverter transformer 100. Therefore, even if a new inverter transformer has a new output voltage, such as a higher output voltage, the inverter transformer can keep the same thickness.

The inverter transformer 100 utilizes partition troughs to enhance the insulation effect thereof and the coils are wound parallel to the assembly direction of the inverter transformer 100. Accordingly, the thickness of the inverter transformer 100 can be efficiently reduced and only one inverter transformer can supply at least two cold cathode fluorescent lamps. Therefore, a liquid crystal display with the inverter transformer according to the present invention can efficiently reduce the thickness and the manufacturing cost thereof.

The inverter transformer according to the present invention is not limited to the Y core and the U core. The inverter transformer according to the present invention can be implemented by a first core with a plurality parallel fork elements combined with a second core with a plurality of fork position openings; that is, the inverter transformer can efficiently increase the quantity of secondary coils to supply a plurality of cold cathode fluorescent lamps.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. An inverter transformer comprising:

a first core having a plurality of fork elements, a connection element, and a bottom element, the fork elements being parallel to each other and coupling to one side of the connection element, another side of the connection element further coupling to the bottom element; and a second core having a plurality of fork position openings and a bottom opening, wherein when the first core is coupled to the second core, each of the fork position openings corresponds to one of the fork elements and the bottom opening corresponds to the bottom element.

2. The inverter transformer of claim 1, wherein the second core further comprises a bottom indentation to form a bottom gap between the first core and the second core when the first core is coupled to the second core.

3. The inverter transformer of claim 2, wherein the second core further comprises a plurality of fork position indentations to form a plurality of fork position gaps between the first core and the second core when the first core is coupled to the second core, wherein a quantity of the fork position indentations is equal to a quantity of the fork elements.

4. The inverter transformer of claim 3, further comprising a primary coil module and a plurality of secondary coil modules, the bottom indentation and the fork position indentations further coupling to the primary coil module and the secondary coil modules so as to be fixed on the first core when the first core is coupled to the second core.

5. The inverter transformer of claim 4, wherein each of the secondary coil modules of the inverter transformer further comprises a plurality of partition troughs.

6. An inverter transformer comprising:

a Y core having two fork elements, a connection element, and a bottom element, the fork elements being parallel to each other and coupling to one side of the connection element, and another side of the connection element further coupling to the bottom element; and a U core having two fork position openings and a bottom opening, wherein when the U core is coupled to the Y core, each of the fork position openings corresponds to one of the fork elements and the bottom opening corresponds to the bottom element.

7. The inverter transformer core structure of claim 6, wherein the U core further comprises a bottom indentation to form a bottom gap between the Y core and the U core when the U core is coupled to the Y core.

8. The inverter transformer of claim 7, wherein the U core further comprises two fork position indentations to form two fork position gaps between the Y core and the U core when the U core is coupled to the Y core.

9. The inverter transformer of claim 8 further comprising a primary coil module and two secondary coil modules, the bottom indentation and the fork position indentations further coupling to the primary coil module and the secondary coil modules so as to be fixed on the Y core when the U core is coupled to the Y core.

10. The inverter transformer of claim 9, wherein each of the secondary coil modules of the inverter transformer further comprises a plurality of partition troughs.

11. The inverter transformer of claim 1, further comprising:

a primary coil module coupling to the bottom element of the first core; and a plurality of secondary coil module coupling one-to-one to the fork elements.

12. The inverter transformer of claim 1, wherein the second core further comprises a bottom indentation to form a bottom gap between the first core and the second core when the first core is coupled to the second core, wherein the bottom indentation further locks the primary coil module.

13. The inverter transformer of claim 12, wherein the second core further comprises a plurality of fork position indentations to form a plurality of fork position gaps between the first core and the second core when the first core is coupled to the second core, wherein each of the fork position indentations further locks one-to-one with one of the secondary coil modules.

14. The inverter transformer of claim 13, wherein each of the secondary coil modules of the inverter transformer further comprises a plurality of partition troughs parallel to a assembly direction of the inverter transformer fixed on a print circuit board so that magnetic circuits formed by the secondary coil module are parallel to the assembly direction of the inverter transformer fixed on the print circuit board.

* * * * *